US009022484B2

(12) United States Patent
Naidoo et al.

(10) Patent No.: US 9,022,484 B2
(45) Date of Patent: May 5, 2015

(54) MATERIAL HANDLING SYSTEM FOR MINING MACHINE

(75) Inventors: Dushendra Naidoo, Johannesburg (ZA); Graeme Mackay, Alberton (ZA)

(73) Assignee: Joy MM Delaware, Inc., Wilmington, DE (US)

( * ) Notice: Subject to any disclaimer, the term of this patent is extended or adjusted under 35 U.S.C. 154(b) by 48 days.

(21) Appl. No.: 13/566,462

(22) Filed: Aug. 3, 2012

(65) Prior Publication Data

US 2013/0033089 A1 Feb. 7, 2013

Related U.S. Application Data

(60) Provisional application No. 61/514,542, filed on Aug. 3, 2011, provisional application No. 61/514,543, filed on Aug. 3, 2011, provisional application No. 61/514,566, filed on Aug. 3, 2011.

(51) Int. Cl.

| | |
|---|---|
| ***E21C 35/08*** | (2006.01) |
| ***E21F 13/06*** | (2006.01) |
| ***E21C 25/16*** | (2006.01) |
| ***E21C 31/12*** | (2006.01) |
| *E21C 35/24* | (2006.01) |
| *E21D 9/10* | (2006.01) |
| *E21C 35/10* | (2006.01) |

(52) U.S. Cl.

CPC ..... *E21C 35/08* (2013.01); *E21C 35/24* (2013.01); *E21D 9/108* (2013.01); *E21C 35/10* (2013.01); *E21F 13/06* (2013.01); *E21C 25/16* (2013.01); *E21C 31/12* (2013.01)

(58) Field of Classification Search

USPC ..... 299/18, 64

See application file for complete search history.

(56) References Cited

U.S. PATENT DOCUMENTS

| | | | | |
|---|---|---|---|---|
| 3,362,752 | A * | 1/1968 | Densmore | 299/18 |
| 3,387,889 | A * | 6/1968 | Ziemba et al. | 299/12 |
| 3,602,551 | A * | 8/1971 | Velegol | 406/39 |
| 3,726,562 | A | 4/1973 | Wharton, III | |
| 3,743,356 | A * | 7/1973 | Sheets | 299/18 |
| 4,249,778 | A * | 2/1981 | McGuire | 299/64 |
| 4,266,829 | A * | 5/1981 | Divers | 299/64 |
| 4,273,383 | A | 6/1981 | Grisebach | |
| 4,289,509 | A * | 9/1981 | Holter | 96/356 |
| 4,550,952 | A | 11/1985 | Hall | |
| 6,733,086 | B1 | 5/2004 | McSharry et al. | |
| 6,857,706 | B2 | 2/2005 | Hames et al. | |
| 6,918,636 | B2 | 7/2005 | Dawood | |
| 6,929,330 | B2 | 8/2005 | Drake et al. | |
| 7,695,071 | B2 | 4/2010 | Jackson et al. | |
| 7,934,776 | B2 | 5/2011 | de Andrade et al. | |
| 2004/0207247 | A1 | 10/2004 | Jackson et al. | |
| 2007/0114313 | A1 | 5/2007 | Knotts | |

(Continued)

OTHER PUBLICATIONS

International Search Report and Written Opinion for Application No. PCT/US2012/049569 dated Oct. 25, 2012 (12 pages).

*Primary Examiner* — John Kreck

(74) *Attorney, Agent, or Firm* — Michael Best & Friedrich LLP

(57) ABSTRACT

A mining machine for cutting material from a mine wall includes a cutting head that is movable to engage the mine wall, a vacuum duct positioned proximate the cutting head and including an inlet for receiving the material that is cut from the mine wall, and a sizer for reducing the size of material that passes into the vacuum duct, the sizer being positioned proximate the inlet.

27 Claims, 11 Drawing Sheets

(56) References Cited

U.S. PATENT DOCUMENTS

2009/0058172 A1* 3/2009 de Andrade et al. ..... 299/55
2011/0181097 A1 7/2011 Skea
2011/0227397 A1 9/2011 de Andrade et al.
2012/0032494 A1 2/2012 Veldman et al.

* cited by examiner

MATERIAL HANDLING SYSTEM FOR MINING MACHINE

RELATED APPLICATIONS

This application claims the benefit of prior-filed, co-pending U.S. Provisional Application No. 61/514,542, filed Aug. 3, 2011, U.S. Provisional Patent Application No. 61/514,543, filed Aug. 3, 2011, and U.S. Provisional Patent Application No. 61/514,566, filed Aug. 3, 2011, the entire contents of all of which are hereby incorporated by reference. The present application also incorporates by reference the entire contents of PCT Patent Application No. PCT/US2012/049532, filed Aug. 3, 2012 and titled "AUTOMATED OPERATIONS OF A MINING MACHINE" and U.S. Non-Provisional patent application Ser. No. 13/566,150, filed Aug. 3, 2012 and titled "STABILIZATION SYSTEM FOR MINING MACHINE".

BACKGROUND

The present invention relates to mining equipment, and particularly continuous underground mining machines.

Traditionally, excavation of hard rock in the mining and construction industries, has taken one of either two forms, explosive excavation or rolling edge disc cutter excavation. Explosive mining entails drilling a pattern of holes of relatively small diameter into the rock being excavated, and loading those holes with explosives. The explosives are then detonated in a sequence designed to fragment the required volume of rock for subsequent removal by suitable loading and transport equipment. However, the relatively unpredictable size distribution of the rock product formed complicates downstream processing.

Mechanical fragmentation of rock eliminates the use of explosives; however, rolling edge cutters require the application of very large forces to crush and fragment the rock under excavation. On a conventional underground mining machine, a cutter head liberates material from a mine wall. The material falls to the mine floor under the cutter head and is directed onto a conveyor for transportation away from the mine wall. This operation produces large amounts of dust and debris and results in loss of mined material.

SUMMARY

In one embodiment, the invention provides a mining machine for cutting material from a mine wall. The mining machine includes a cutting head that is movable to engage the mine wall, a vacuum duct positioned proximate the cutting head and including an inlet for receiving the material that is cut from the mine wall, and a sizer for reducing the size of material that passes into the vacuum duct, the sizer being positioned proximate the inlet.

In another embodiment, the invention provides a material handling system for a mining machine, the mining machine including a cutting head. The material handling system includes: a suction source including a material collector; a vacuum conduit extending between the suction source and the mining machine, the vacuum conduit including an inlet positioned adjacent the cutting head, the inlet receiving material that is cut from a mine wall by the cutting head, the vacuum conduit being in fluid communication with the suction source to transport the cut material from the inlet to the material collector; and a sizer for reducing the size of material that passes into the vacuum duct, the sizer being positioned proximate the inlet.

In yet another embodiment, the invention provides a method for processing material that is cut by a mining machine including a cutting head. The method includes: cutting the material from a mine wall; reducing the cut material to a desired size as the cut material is guided toward an inlet of a vacuum conduit; and transporting the cut material through the vacuum conduit to a material collector.

In still another embodiment, the invention provides a mining machine for cutting material from a mine wall. The mining machine includes: a cutting head that is movable to engage the mine wall, the cutting head being pivotable about an axis oriented substantially perpendicular to the mine floor; and a vacuum duct positioned proximate the cutting head, the vacuum duct including an inlet for receiving the material that is cut from the mine wall.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
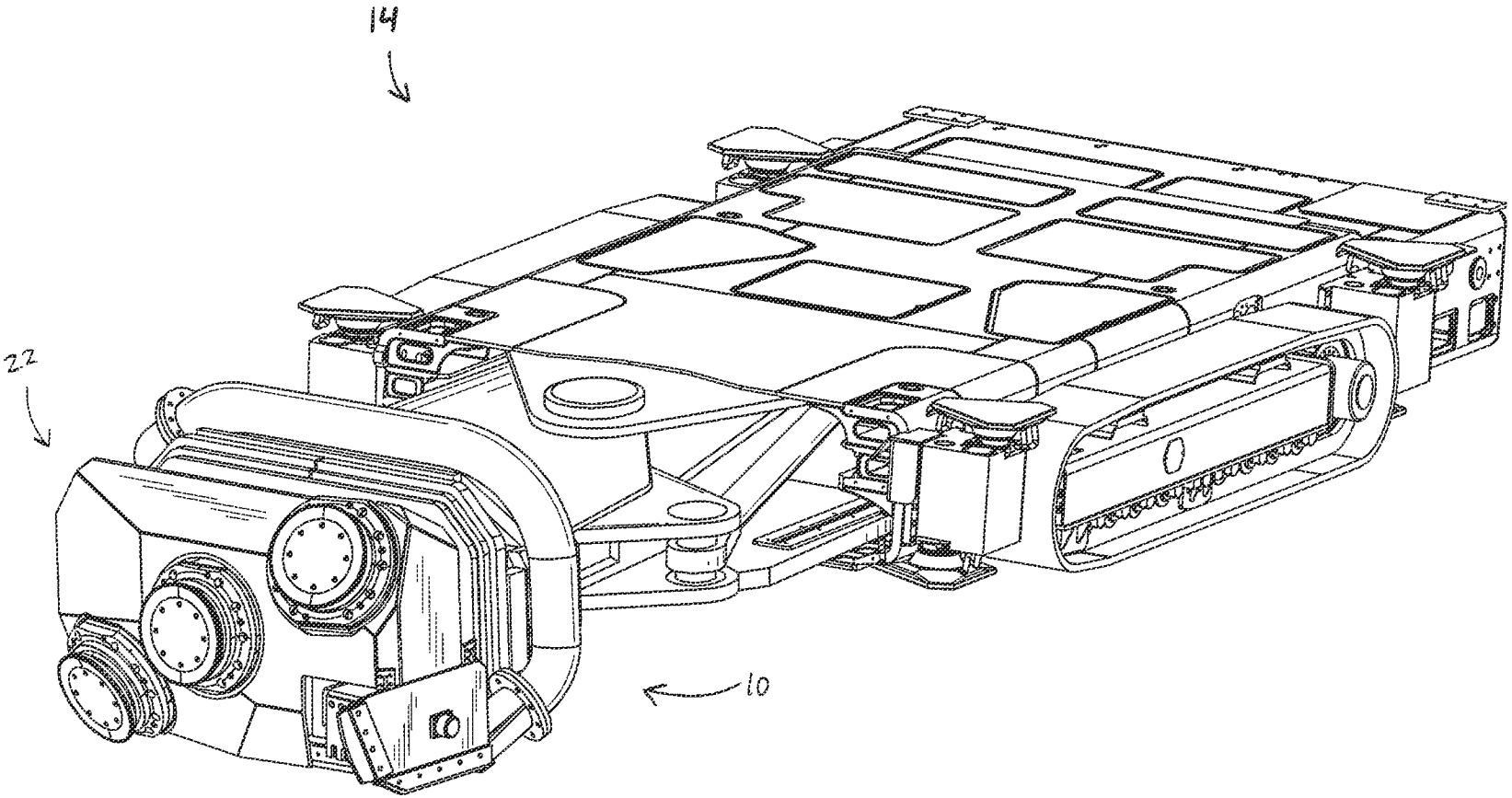
FIG. 1 is a perspective view of a mining machine.
Figure 2:
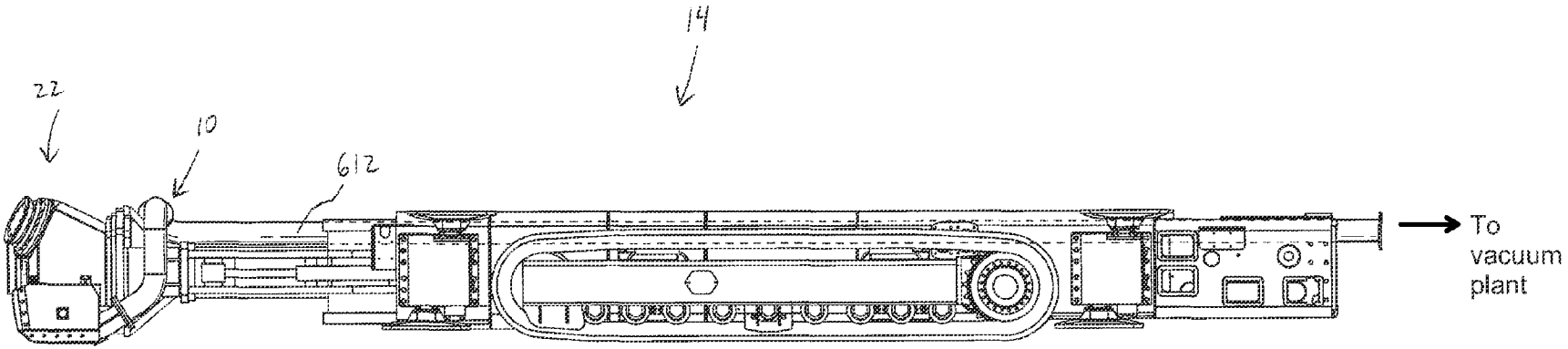
FIG. 2 is a side view of the mining machine of FIG. 1.

FIGS. 1 and 2 illustrates a material handling system 10 for use with a continuous mining machine 14. The mining machine 14 includes a cutting mechanism 22. Before describing the material handling system 10, the mining machine 14 and cutting mechanism 22 will be described in detail.

Figure 3:
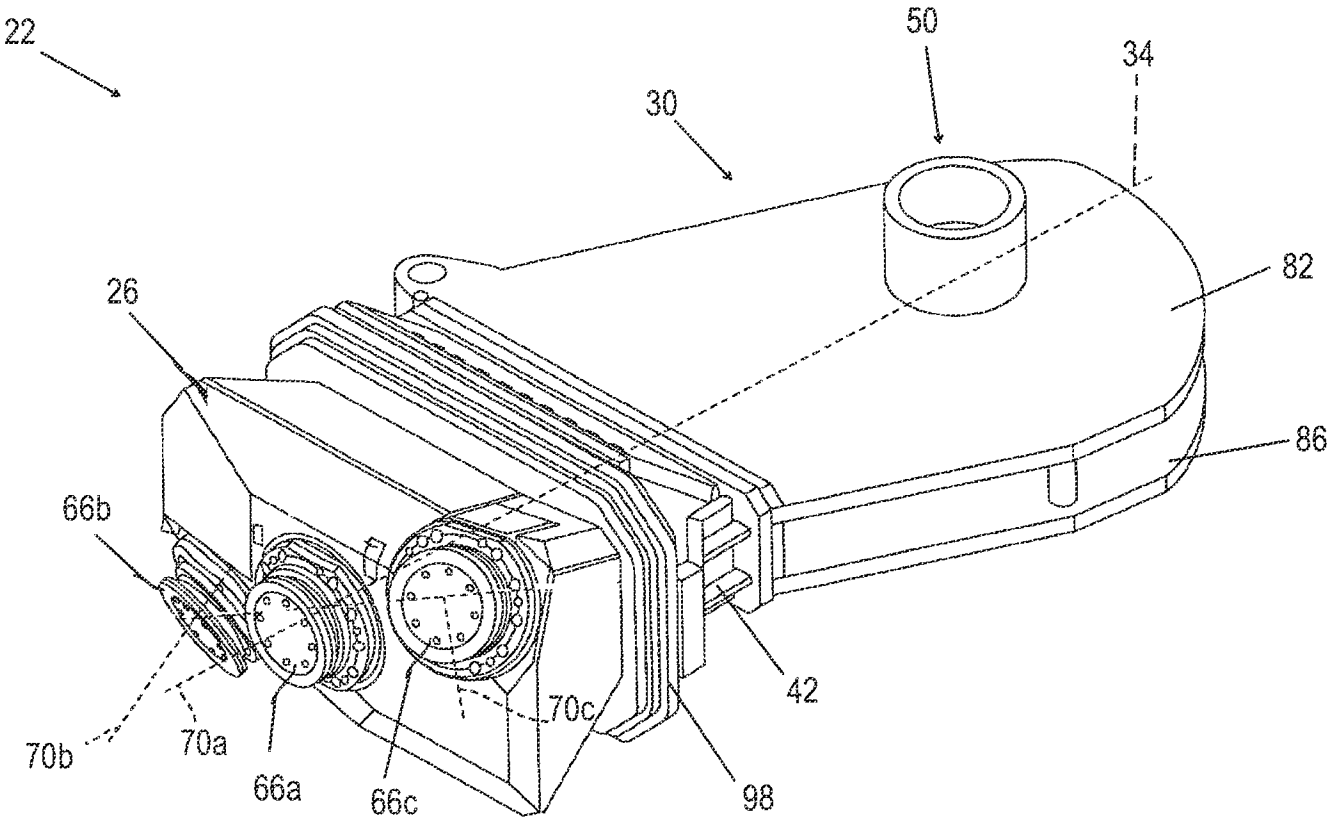
FIG. 3 is a perspective view of a cutting mechanism.
Figure 4:
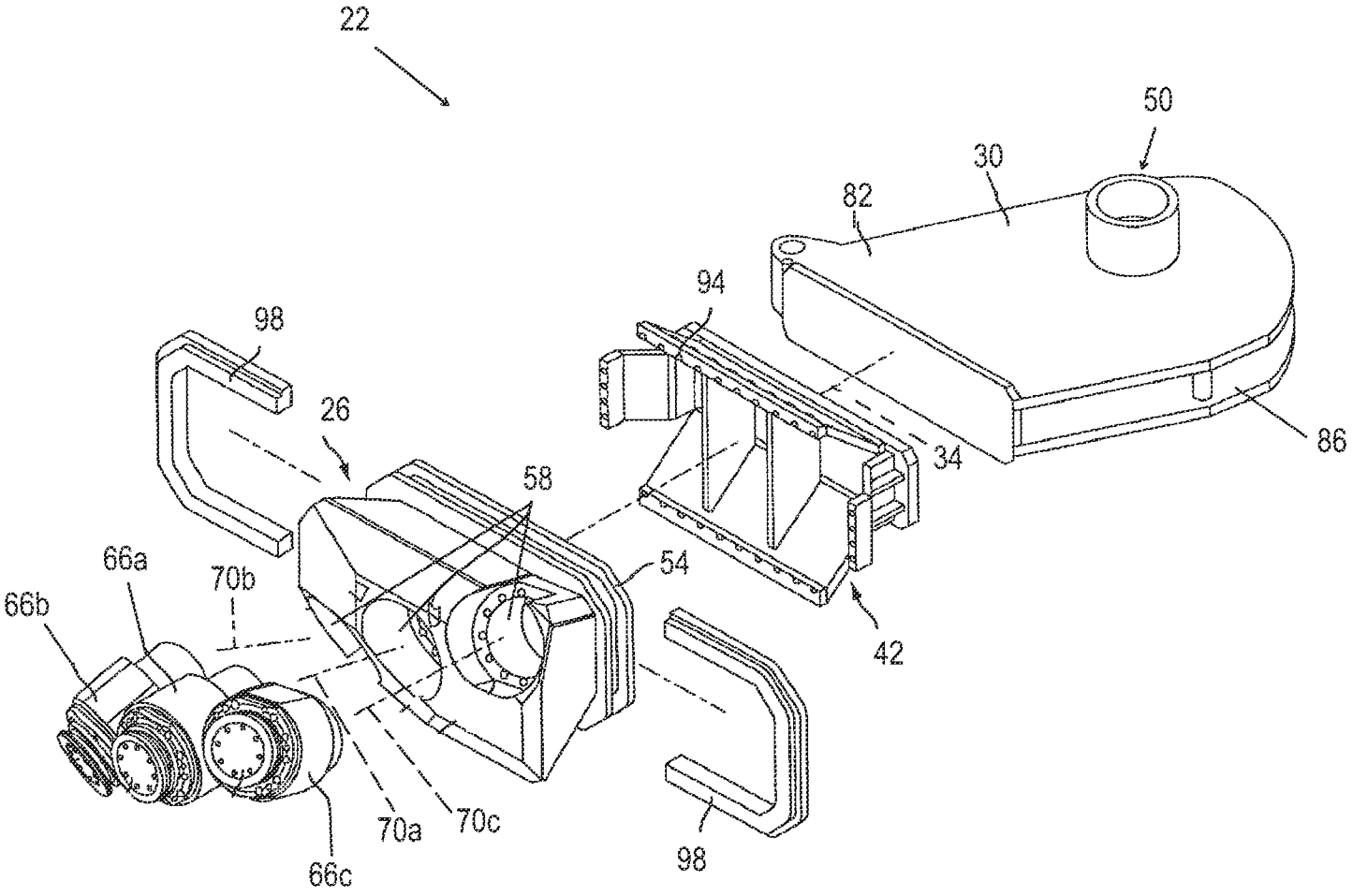
FIG. 4 is a perspective exploded view of the cutting mechanism of FIG. 3.

As shown in FIGS. 3 and 4, the cutting mechanism 22 includes a cutter head 26, an arm 30 defining a longitudinal axis 34, a bracket 42 for attaching the cutter head 26 to the arm 30, and a pivot assembly 50 coupled to the mining machine 14 and permitting the arm 30 to be pivoted vertically. The cutter head includes a flange 54 and three openings 58 (FIG. 4), each of which releasably receives a disc cutter assembly 66. The disc cutter assemblies 66 are spaced apart from one another and oriented along separate axes. Each disc cutter assembly 66 defines a longitudinal axis of rotation 70, and the disc cutter assemblies 66 are spaced apart from one another and mounted at an angle such that the axes of rotation 70 are not parallel and do not intersect. For instance, in the embodiment shown in FIG. 3, the axis 70*a* of the center disc cutter assembly 66*a* is substantially coaxial with the longitudinal axis 34 of the arm 30. The axis 70*b* of the lower disc cutter assembly 66*b* is at an angle to the axis 70*a* of the center disc cutter 66*a*. The axis 70*c* of the upper disc cutter assembly 66*c* is at an angle to the axes 70*a*, 70*b* of the center disc cutter assembly 66*a* and the lower disc cutter assembly 66*b*. This arrangement of the disc cutter assemblies 66 produces even cuts when the cutter head 26 engages the mine wall. Further embodiments may include fewer or more cutting disc assemblies 66 arranged in various positions.

Figure 5:
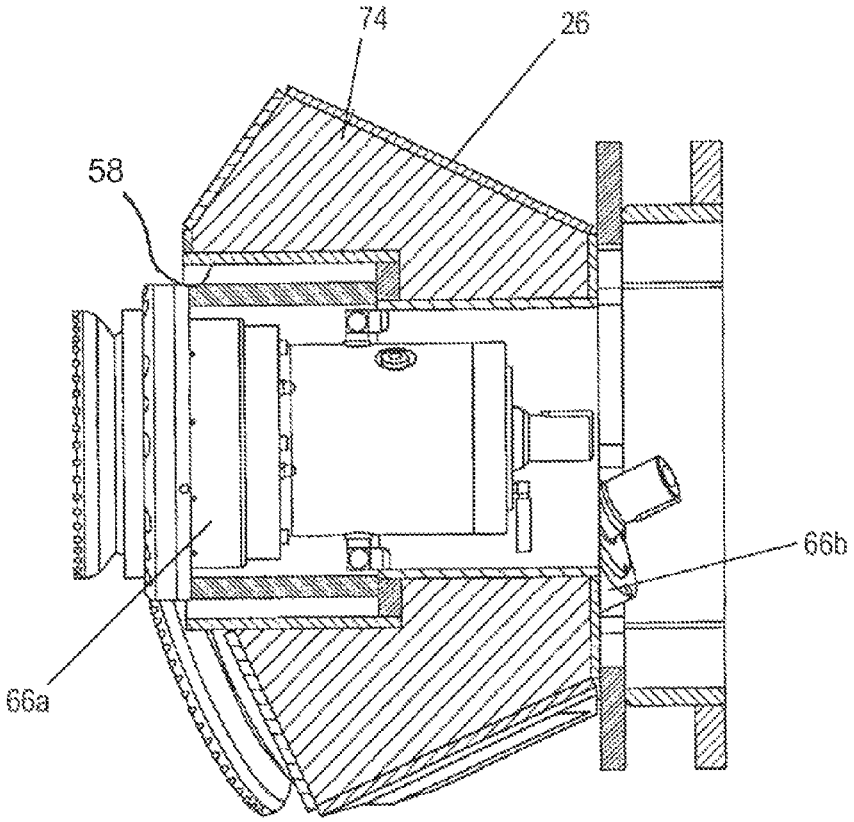
FIG. 5 is a cross-sectional view of a cutter head of the cutting mechanism of FIG. 3.

As shown in FIG. 5, the cutter head 26 also includes an absorption mass 74, in the form of a heavy material, such as lead, located in an interior volume of the cutter head 26 surrounding the three openings 58. By having the three eccentrically driven disc cutter assemblies 66 share a common heavy weight, less overall weight is necessary and permits a lighter and more compact design. In one embodiment, approximately 6 tons is shared among the three disc cutter assemblies 66. The mounting arrangement is configured to react to the approximate average forces applied by each disc cutter assembly 66, while peak cutting forces are absorbed by the absorption mass 74, rather than being absorbed by the arm 30 (FIG. 3) or other support structure. The mass of each disc cutter assembly 66 is relatively much smaller than the absorption mass 74.

In the embodiment shown in FIG. 4, the arm 30 includes a top portion 82 and a bottom portion 86. The bracket 42 includes a flange 94. The bracket 42 is secured to the arm 30 by any suitable fashion, such as welding. The bracket 42 is attached to the cutter head 26 by U-shaped channels 98. Each channel 98 receives the cutter head flange 54 and the bracket flange 94 to secure the cutter head 26 to the bracket 42. A resilient sleeve (not shown) is placed between the cutter head 26 and the bracket 42 to isolate cutter head vibrations from the arm 30.

The disc cutter assemblies 66 are driven to move in an eccentric manner. This is accomplished, for instance, by driving the disc cutter assemblies 66 using a drive shaft (not shown) having a first portion defining a first axis of rotation and a second portion defining a second axis of rotation that is radially offset from the first axis of rotation. The magnitude of eccentric movement is proportional to the amount of radial offset between the axis of rotation of each portion of the shaft. In one embodiment, the amount of offset is a few millimeters, and the disc cutter assembly 66 is driven eccentrically through a relatively small amplitude at a high frequency, such as approximately 3000 RPM.

The eccentric movement of the disc cutter assemblies 66 creates a jackhammer-like action against the mineral to be mined, causing tensile failure of the rock so that chips of rock are displaced from the rock surface. The force required to produce tensile failure in the rock is an order of magnitude less than that required by conventional rolling edge disc cutters to remove the same amount of rock. The action of the disc cutter assembly 66 against the under face is similar to that of a chisel in developing tensile stresses in a brittle material, such as rock, which is caused effectively to fail in tension. In another embodiment, the disc cutter 66 also nutates such that the axis of rotation moves in a sinusoidal manner as the disc cutter 66 oscillates. This is accomplished by making the axis about which the disc cutter drive shaft rotates angularly offset from a disc cutter housing.

The mining machine 14 is operated by advancing the arm 30 toward the material to be mined a first incremental distance, pivoting the arm 30 to cut the material, and then advancing the arm 30 toward the material to be mined a second incremental distance. During operation, the lower disc cutter assembly 66*b* is the first to contact the mineral to be mined when the arm 30 is pivoted in a first direction (clockwise as viewed from the top of the arm 30 in FIG. 3) about the pivot assembly 50. This results in the lower disc cutter assembly 66*b* dislodging material that falls away from the mine wall. As the center disc cutter assembly 66*a* contacts the mineral to be mined, the space below the center disc cutter assembly 66*a* has been opened by the lower disc cutter assembly 66*b*, so the material dislodged by the center disc cutter assembly 66*a* falls away from the mine wall. Likewise, as the upper disc cutter assembly 66*c* engages the material, the space below the upper disc cutter assembly 66*c* is open, and the material dislodged by upper disc cutter assembly 66*c* falls to the floor. Since the leading disc cutter is in the lower most position, the material dislodged by leading disc cutters is not re-crushed by trailing disc cutter, reducing wear on the disc cutters. In addition, the disc cutter assemblies 66 are positioned so that each disc cutter 66 cuts equal depths into the material to be mined. This prevents unevenness in the mineral to be mined that could obstruct the progress of the mining machine 14.

The material handling system 10 may be used in combination with the continuous mining machine 14 described above, or may be used in combination with a mining machine as described in U.S. Pat. No. 7,934,776, filed Aug. 31, 2007, the entire contents of which are incorporated herein by reference. The material handling system 10 is described in detail below.

Figure 6:
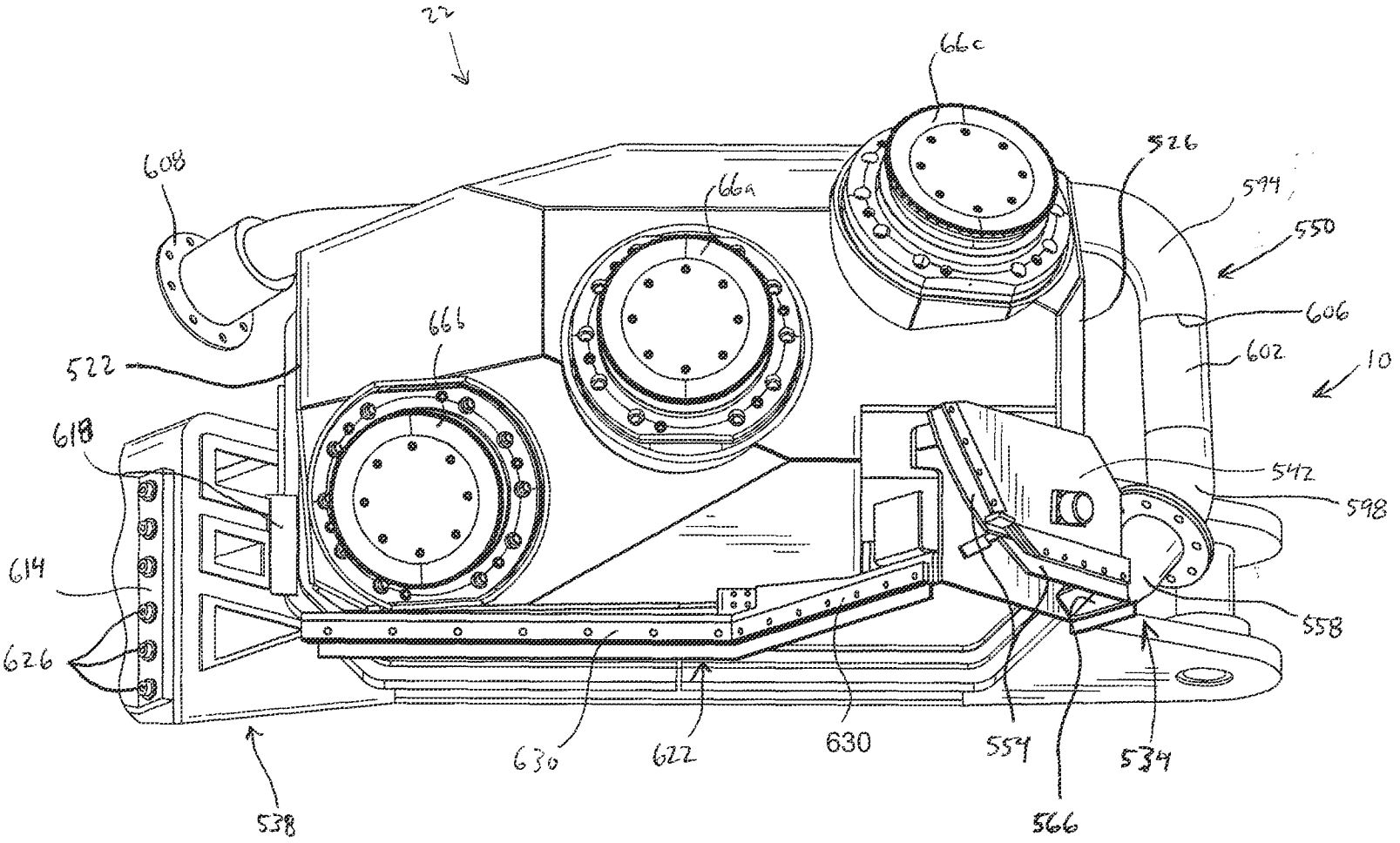
FIG. 6 is a front perspective view of a cutter head.

FIG. 6 illustrates the cutting mechanism 22 and the material handling system 10. The cutter head 26 includes a first or leading side 522 and a second or trailing side 526. The material handling system 10 functions to collect, entrain and remove material cut by the continuous mining machine 14. The material handling system 10 additionally traps dust and reclaims fine material particles that would otherwise be lost.

Figure 7:
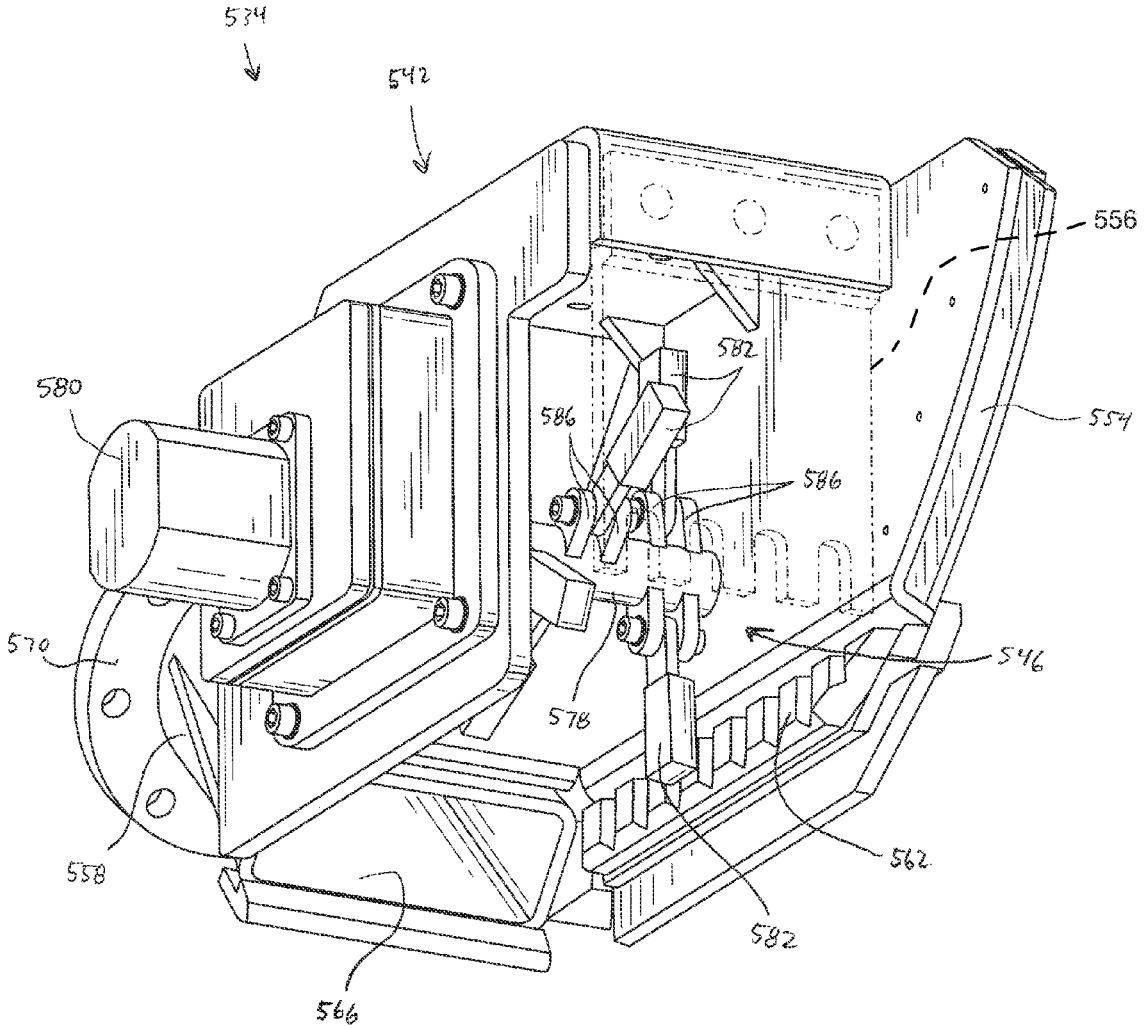
FIG. 7 is a lower perspective view of a vacuum duct.

Referring to FIGS. 6 and 7, the material handling system 10 includes a vacuum system 534 and an entrainment system 538 (FIG. 6). The vacuum system 534 includes a vacuum duct 542, a sizer 546 (FIG. 7) proximate the vacuum duct 542, and a vacuum transfer pipe 550. The entrainment system 538 is described below, following the description of the vacuum system 534.

Figure 8:
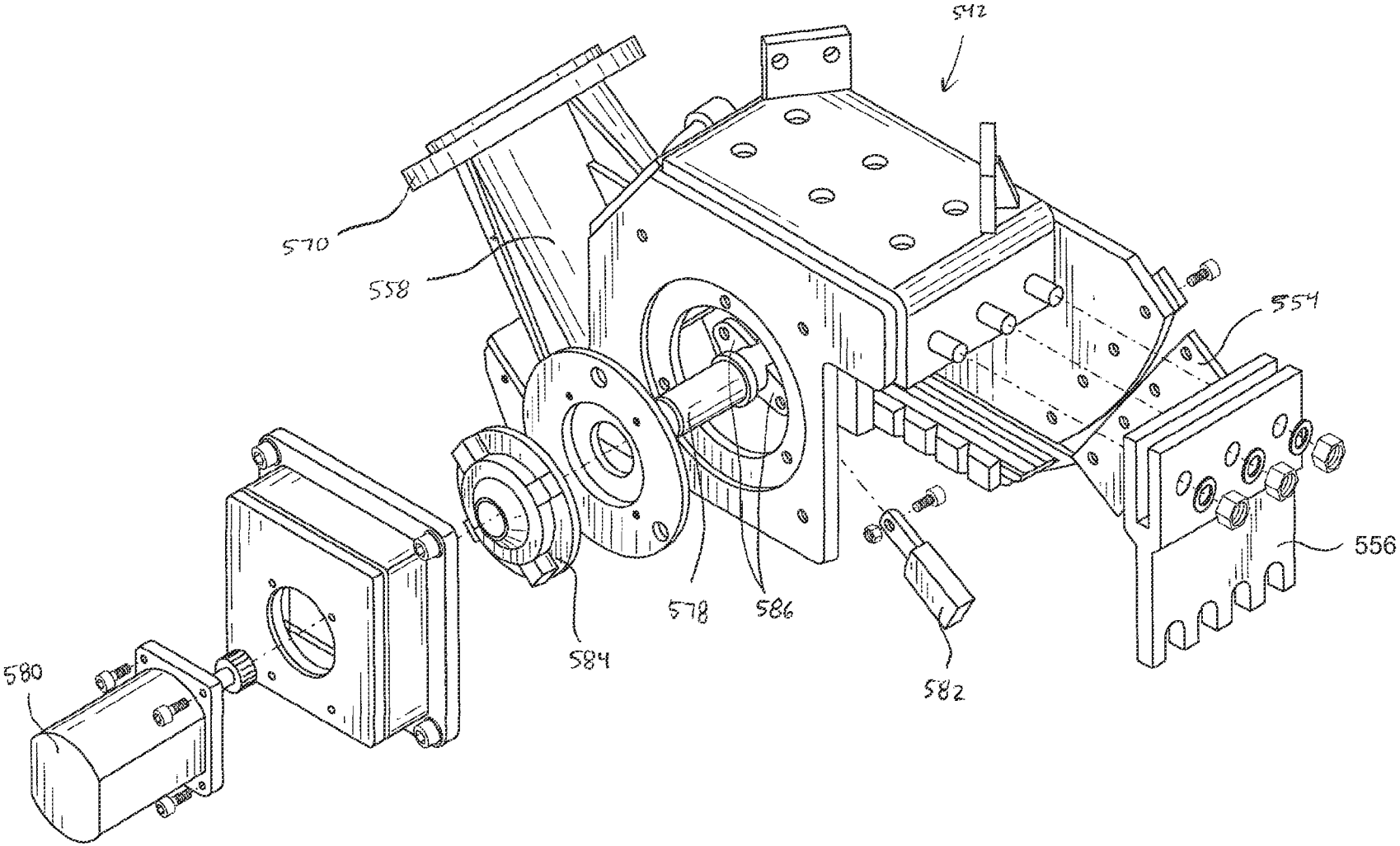
FIG. 8 is an exploded perspective view of the vacuum duct of FIG. 7.

Referring to FIGS. 6-8, the vacuum duct 542 is positioned adjacent the trailing side 526 cutter head 26 and includes a scraper plate 554, a shield 556 (FIG. 8), and a suction inlet or chute 558. In one embodiment, the vacuum duct 542 includes a reinforced abrasion-resistant structure. The scraper plate 554 is profiled to the shape of the cut face. The scraper plate 554 functions to contain, scrape and guide the cut material into the suction chute 558. The scraper plate 554 may be made from steel, for example. Wear-resistant bars 562 (FIG. 7) are mounted onto the scraper plate 554 and are in direct contact with the bulk of the cut material. The shield 556 (FIG. 8) guides cut material past the sizer 546.

As shown in FIG. 7, the suction chute 558 is mounted to the vacuum duct 542 and positioned away from the mine wall.

The suction chute 558 is inclined at an angle with respect to the ground, or support surface, and includes a throat area 566 designed for optimal material flow. In the illustrated embodiment, the angle of the suction chute 558 is approximately 45 degrees with respect to the ground. Slip rings form a flange 570 located on one end of the suction chute 558, opposite the throat area 566, such that the vacuum transfer pipe 550 (FIG. 6) may be secured to the suction chute 558 at the flange 570.

Referring to FIGS. 7 and 8, the sizer 546 is positioned within the vacuum duct 542 proximate the suction chute 558. The sizer 546 includes a shaft 578 coupled to a motor 580 and multiple hammers 582 coupled to the shaft 578. The shaft 578 is coupled to the duct 542 by bearings 584 (FIG. 8). In the illustrated embodiment, the shaft 578 includes six pairs of retaining brackets 586 that are coupled to the shaft 578 and rotate with the shaft 578. Each pair of retaining brackets 586 receives one of the hammers 582 and secures the hammer 582 to the shaft 578. As the motor 580 rotates the shaft 578, the hammers 582 impact rock and cut material passing around the shaft 578 and into the chute 558, thereby fracturing the rock. In the illustrated embodiment, the hammers 582 are made of wear-resistant plate steel and designed for impact strength. The geometry of each hammer 582 is designed to impart maximal breaking force to the cut rock.

In the illustrated embodiment, the retaining brackets 586 are arranged in pairs such that one retaining bracket 586 is coupled to one side of the shaft 578 and another retaining bracket 586 is coupled to another side of the shaft 578 diametrically opposed to the one side. The pairs of brackets 586 are positioned at various points along the length of the shaft 578. The retaining brackets 586 are angularly offset with respect to one another such that each hammer 582 is in a different angular position from the other hammers 582. In another embodiment, the sizer 546 may include fewer or more retaining brackets 586 and hammers 582. Also, the retaining brackets 586 may be configured in a manner other than in pairs, and the retaining brackets 586 may be positioned in parallel alignment along the shaft 78 such that the hammers 582 are parallel to each other during rotation.

Figure 11:
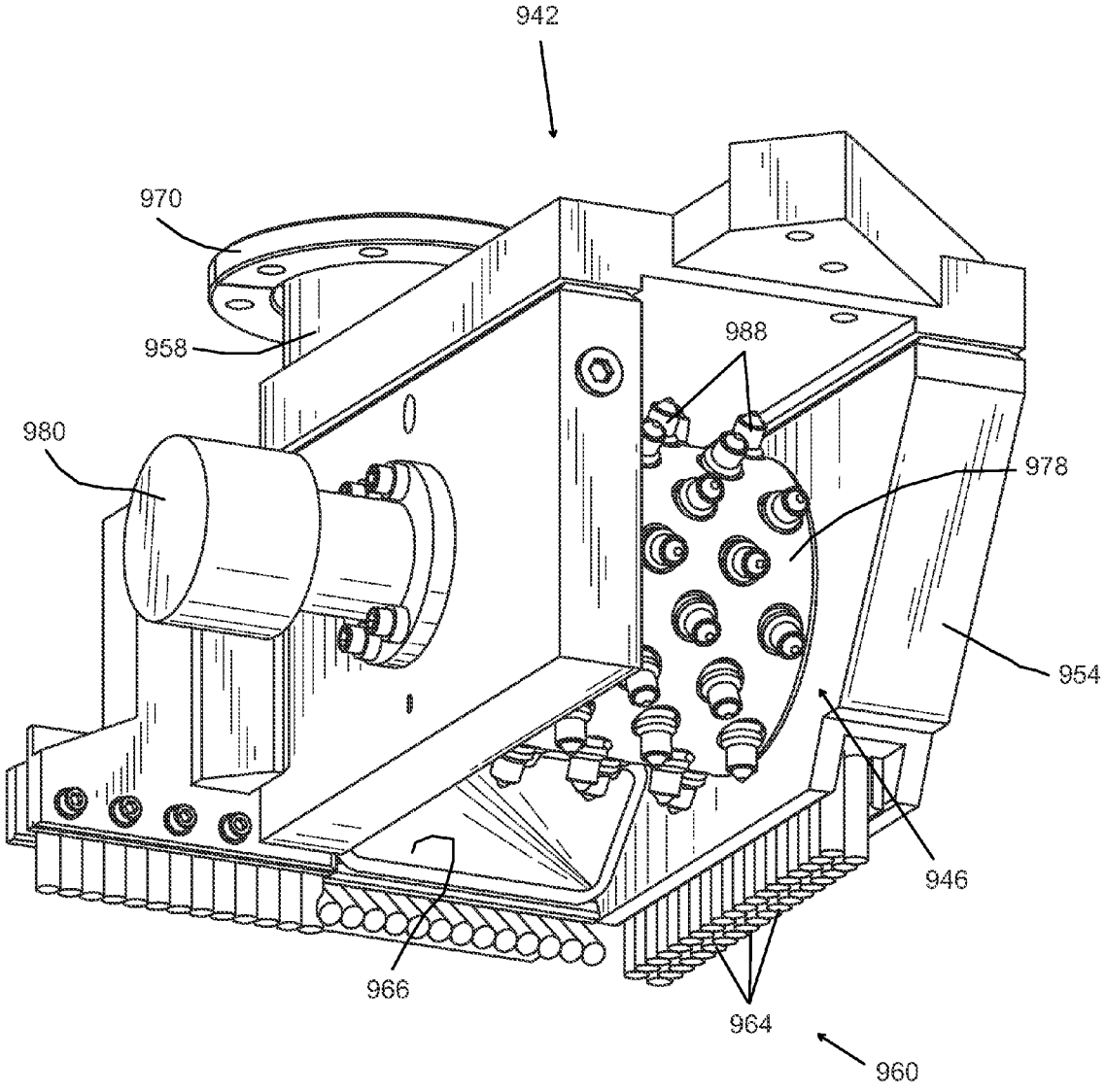
FIG. 11 is a lower perspective view of a vacuum duct according to another embodiment.

FIG. 11 shows another embodiment of the vacuum duct 942 and sizer 946. The illustrated vacuum duct 942 and sizer 946 are similar to the vacuum duct 542 and sizer 546 described above with reference to FIGS. 1-8, and similar features are indicated with similar reference numbers plus 400.

As shown in FIG. 11, the vacuum duct 942 includes a scraper plate 954, a suction inlet or chute 958, and a skirting 960. In the illustrated embodiment, the skirting 960 includes multiple wire ropes 964 suspended from the vacuum duct 942 to entrain and guide cut material into the vacuum duct 942. The sizer 946 includes a drum 978 coupled to the motor 980 and multiple picks 988 coupled to the drum 978. In one embodiment, the drum 978 is coupled to the duct 942 by toughmet bushings (not shown). The picks 988 extend from the drum 978 and are oriented to engage the cut material passing by the drum 978. As the motor 980 rotates the drum 978, the picks 988 impact rock and cut material passing around the drum 978 and into the chute 958, thereby fracturing the rock. The embodiment of FIG. 11 provides a robust mounting configuration for the sizer 946, permitting use of a motor 980 with higher torque. In addition, the configuration provides easy access to the components of the sizer 946 for lubrication, and provides improved suction flow efficiency.

Referring again to FIG. 6, the vacuum transfer pipe 550 is rigidly attached to the cutter head 26 by a mounting support (not shown), and includes a first rigid portion 594, a second rigid portion 598, and a flexible hose 602 coupled between the first rigid portion 594 and the second rigid portion 598. The first rigid portion 594 includes a first end 606 coupled to the flexible hose 602 and a second end 610 coupled to a vacuum conduit 612 (FIG. 2), which is in fluid communication with a dewatering plant 634 (FIG. 9) for providing suction in the conduit 612. The second rigid portion 598 is coupled to the flange 570 and to the flexible hose 602 to provide fluid communication between the suction chute 558 and the flexible hose 602. The flexibility of the hose 602 accommodates possible alignment and manufacturing errors in the suction chute 558 and the first rigid portion 594. The flexible hose 602 is capable of quick disassembly and inspection if a blockage is encountered in the suction chute 558.

In other embodiments, a secondary duct is mounted on the cutter head 26. The secondary duct is mounted on a side plate on the leading side 522 of the cutter head 26. The secondary duct is activated during a return swing of the cutter head 26 to remove any remaining cut material. In yet another embodiment, the vacuum duct 542 may be mounted on an extended and/or secondary boom configuration or on a secondary cutter head.

Figure 10:
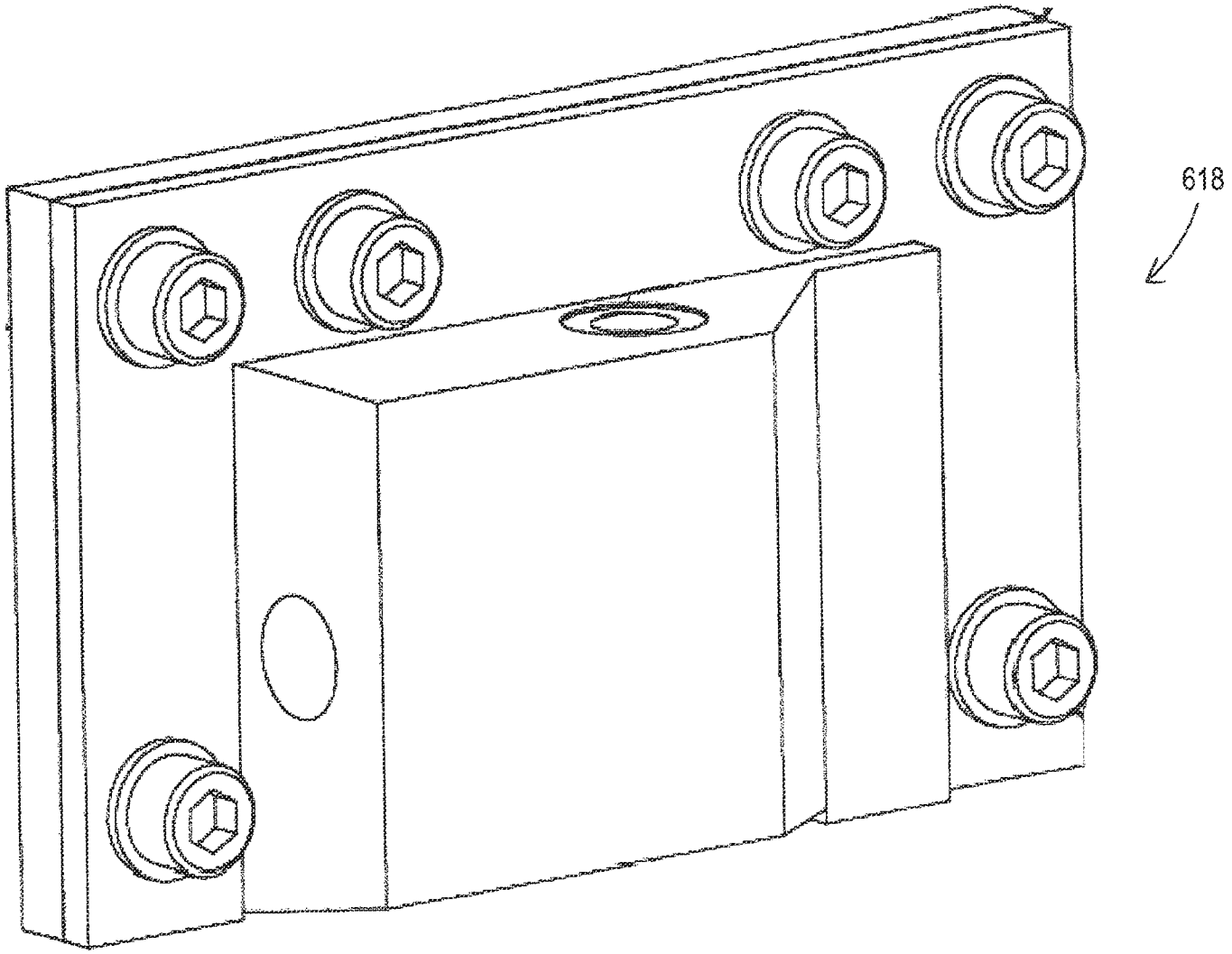
FIG. 10 is a perspective view of a spray block.

Referring again to FIG. 6, the entrainment system 538 includes a first spray-block 614, a second spray-block 618, and a skirt 622. The primary spray-block 614 includes multiple spray nozzles 626 and is positioned on the leading side 522 of the cutter head 26. The secondary spray-block 618 includes multiple spray nozzles 626 and is positioned adjacent the cutter head 26. FIG. 10 illustrates an example of secondary spray-block 618. As shown in FIG. 6, the skirt 622 includes multiple reinforced pads 630 that contact the mine wall. In one embodiment, the skirt 622 is made from steel and the pads 630 are made from rubber.

As rock is cut from the mine wall, the skirt 622 and high-pressure water from the spray blocks 614, 618 contain cut material within an area proximate the mine wall. The primary spray-block 614 clears cut material below a lower cutting disc assembly **66*b*, while the secondary spray-block 618 entrains the material that builds up under the cutter head 26. The spray-blocks 614, 618 urge the material toward the vacuum duct 542. The cut material is guided along the skirt 622 and is fed into the vacuum duct 542, whereby the rotating hammers 582 impact and break apart the rock. Suction provided by the dewatering plant 634 (FIG. 9) pulls the water-entrained rock material through the throat area 566, the suction chute 558, and into the transfer pipe 550**.

Figure 9:
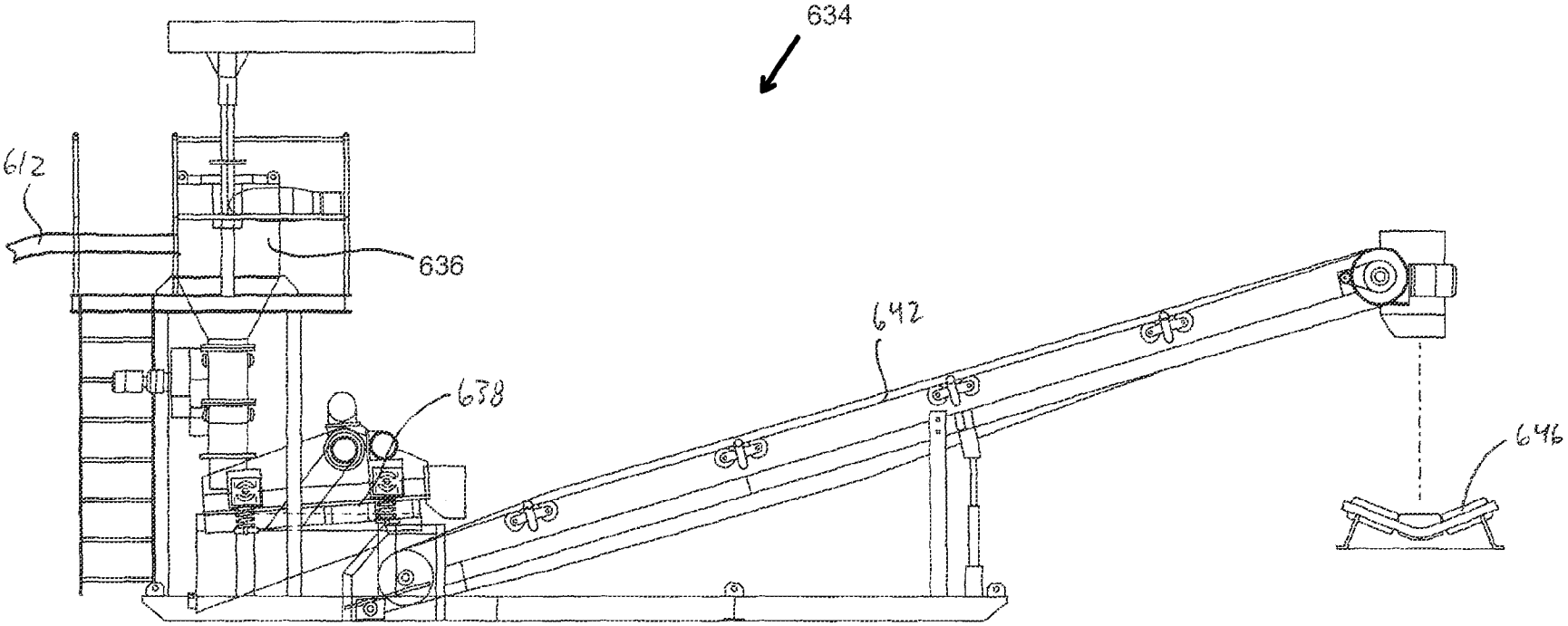
FIG. 9 is a side view of a dewatering plant.

As shown in FIG. 9, the cut material passes through the flexible conduit 612 from the cutting mechanism 22 (FIG. 2) and is transported to the dewatering plant 634. The dewatering plant 634 includes a collector system 636 for providing suction in the conduit 612 and collecting the cut material, a vibrating screen 638, and a mini-conveyor 642. After the material is deposited in the collector 636, the material is discharged onto the vibrating screen 638 that separates the rock from the water. The de-watered material is then transferred to the mini-conveyor 642, from where it is discharged onto a mine strike conveyor 646 and carried away for further processing.

The vacuum system 534 is controlled from the machine 14 by a vacuum system controller (not shown) that is linked wirelessly to a machine controller. In further embodiments, other connection methods may be used. The vacuum system 534 is capable of being started and stopped both manually, via remote, and automatically during an automatic cutting sequence. The vacuum system 534 is also capable of starting locally, such as on a starter box.

When an auto-cut sequence is selected, a "start" command signal is sent to the vacuum system controller and cutting continues only if a "vacuum running" feedback signal is given from the vacuum system controller. In the event that communication is lost between the vacuum system controller and the machine controller, while the vacuum system 534 is running, the vacuum system 534 will be maintained in the running state, but can be stopped locally.

Vacuum pressure is monitored during the cutting cycle. If the vacuum pressure drops below a pre-determined limit, or if the vacuum system 534 is stopped, then the control system permits the current auto-cut sequence to complete. When the auto-cut sequence is completed, an auto-cut stop sequence is initiated.

Thus, the invention may provide, among other things, a material handling system for entraining and sizing material that is cut by a continuous mining machine and conveying it away from the mine wall. The system may include a sizer for reduce the material to a desired size.

Various independent features and independent advantages of the invention are set forth in the following claims.

The invention claimed is:

1. A mining machine for cutting material from a mine wall, the mining machine comprising:

a cutting head that is moveable to engage the mine wall;

a vacuum duct coupled to a side of the cutting head, the vacuum duct positioned adjacent an inlet in fluid communication with a suction source and receiving the material that is cut from the mine wall; and a sizer for reducing the size of material that passes into the vacuum duct, the sizer being positioned within the vacuum duct and proximate the inlet.

2. The mining machine of claim 1, wherein the cutting head is pivotable about an axis to engage the mine wall, the axis being oriented substantially perpendicular to the mine floor.

3. The mining machine of claim 1, wherein the cutting head includes a leading side and a trailing side, the leading side being movable into the mine wall before the trailing side, and wherein the vacuum duct is positioned adjacent the trailing side of the cutting head.

4. The mining machine of claim 1, wherein the sizer includes a shaft and at least one hammer coupled to the shaft, the hammer extending from the shaft and impacting material passing toward the inlet as the shaft rotates.

5. The mining machine of claim 1, wherein the sizer includes a drum and at least one pick coupled to the drum for impacting material passing toward the inlet as the drum rotates.

6. The mining machine of claim 1, wherein the sizer is configured to impact material before the material is received by the inlet.

7. The mining machine of claim 1, further comprising an entrainment system including:

a water spray block providing a curtain of water for entraining the cut material in an area proximate the cutting head; and a material deflector for guiding cut material toward the vacuum duct, the deflector being coupled to the cutting head.

8. The mining machine of claim 1, further comprising a conduit in fluid communication with the inlet and including a rigid portion and a flexible portion that is removably coupled to the rigid portion.

9. A material handling system for a mining machine, the mining machine including a cutting head, the material handling system comprising:

a suction source including a material collector;

a vacuum conduit extending between the suction source and the mining machine, the vacuum conduit including an inlet positioned adjacent a trailing side of the cutting head, the inlet receiving material that is cut from a mine wall by the cutting head, the vacuum conduit being in fluid communication with the suction source to transport the cut material from the inlet to the material collector;

a vacuum duct positioned proximate the inlet and coupled to the cutting head; and a sizer for reducing the size of material before the material passes into the vacuum conduit inlet, the sizer being positioned within the vacuum duct and proximate the inlet.

10. The material handling system of claim 9, wherein the sizer includes a shaft and at least one hammer coupled to the shaft, the hammer extending from the shaft and impacting material passing toward the vacuum conduit as the shaft rotates.

11. The mining machine of claim 9, wherein the sizer includes a drum and at least one pick coupled to the drum for impacting material passing toward the vacuum conduit as the drum rotates.

12. The material handling system of claim 9, further comprising a water spray block providing a curtain of water for entraining the cut material in an area proximate the cutting head.

13. The material handling system of claim 9, further comprising a screen for separating the cut material from water that passes through the vacuum conduit inlet.

14. The material handling system of claim 9, wherein the inlet is defined by a chute oriented at an angle relative to a mine floor.

15. The material handling system of claim 9, further comprising a motor for driving the sizer, the motor coupled to the vacuum duct.

16. A method for processing material that is cut by a mining machine including a cutting head, the method comprising:

cutting the material from a mine wall by pivoting the cutting head in a first direction about an axis that is substantially perpendicular to a mine floor such that a leading side of the cutting head engages the mine wall before a trailing side engages the mine wall;

applying a suction force on the trailing side of the cutting head to guide the cut material toward an inlet of a vacuum conduit;

reducing the cut material to a desired size by impacting the material with a sizer as the cut material is guided toward the inlet of the vacuum conduit, the inlet and the sizer positioned adjacent the trailing side of the cutter head; and transporting the cut material through the vacuum conduit to a material collector.

17. The method of claim 16, wherein the sizer includes a shaft and at least one hammer coupled to the shaft, the hammer extending from the shaft and impacting material passing toward the vacuum conduit as the shaft rotates.

18. The method of claim 16, wherein the sizer includes a drum and at least one pick coupled to the drum for engaging material passing toward the vacuum conduit as the drum rotates.

19. The method of claim 16, further comprising entraining the cut material in an area proximate the cutting head.

20. The method of claim 16, further comprising separating the cut material from water received by the vacuum conduit.

21. A mining machine for cutting material from a mine wall and supported on a support surface, the mining machine comprising:

a cutting head that is moveable to engage the mine wall, the cutting head including at least one oscillating disc cutter for cutting material from the mine wall, the cutting head being pivotable about an axis oriented substantially perpendicular to the support surface, the cutting head including a trailing side and a leading side;

a vacuum duct coupled to the trailing side of the cutting head, the vacuum duct positioned adjacent an inlet of a vacuum conduit in fluid communication with a suction source, the inlet receiving the material that is cut from the mine wall; and a sizer positioned within the vacuum duct, the sizer impacting the material before the material passes into the vacuum conduit.

22. The mining machine of claim 21, wherein the sizer is positioned proximate the inlet.

23. The mining machine of claim 21, wherein the sizer includes a rotating shaft and at least one hammer coupled to the shaft, the hammer extending from the shaft and impacting material passing toward the vacuum conduit as the shaft rotates.

24. The method of claim 21, wherein the sizer includes a drum and at least one pick coupled to the drum for impacting material passing toward the vacuum conduit as the drum rotates.

25. The mining machine of claim 21, further comprising an entrainment system including:

a water spray block providing a curtain of water for entraining the cut material in an area proximate the cutting head; and a material deflector for guiding cut material toward the inlet of the vacuum duct, the deflector being coupled to the cutting head.

26. The mining machine of claim 23, wherein the hammers are pivotable relative to the shaft.

27. The mining machine of claim 21, further comprising a motor for driving the sizer, the motor coupled to the vacuum duct.

* * * * *